US006276875B1

(12) United States Patent
Gunnar et al.

(10) Patent No.: US 6,276,875 B1
(45) Date of Patent: Aug. 21, 2001

(54) METHOD AND TRANSPORTER FOR INSTALLATION OR REMOVAL OF A JACKET FOR AN OFFSHORE PLATFORM

(75) Inventors: Foss Gunnar, Den Haag (NL); Per Bull Haugsøen, Oslo (NO)

(73) Assignee: Offshore Shuttle AS, Oslo (NO)

( * ) Notice: Subject to any disclaimer, the term of this patent is extended or adjusted under 35 U.S.C. 154(b) by 0 days.

(21) Appl. No.: 09/331,116

(22) PCT Filed: Dec. 17, 1997

(86) PCT No.: PCT/NO97/00343

§ 371 Date: Aug. 17, 1999

§ 102(e) Date: Aug. 17, 1999

(87) PCT Pub. No.: WO98/26978

PCT Pub. Date: Jun. 25, 1998

(30) Foreign Application Priority Data

Dec. 18, 1996 (NO) ..... 965439
Aug. 1, 1997 (NO) ..... 973561

(51) Int. Cl.[7] ..... E02B 17/08; E02D 29/00

(52) U.S. Cl. ..... 405/203; 405/195.1; 405/204; 405/205; 405/209; 114/260; 114/267; 114/44; 414/138.1

(58) Field of Search ..... 405/195.1, 200, 405/203, 204, 205, 206, 209; 114/258, 44, 259, 45, 260, 264, 265, 267; 414/138.1, 138.2, 137.9, 477, 478, 479

(56) References Cited

U.S. PATENT DOCUMENTS

| | | | | |
|---|---|---|---|---|
| 2,379,685 | * | 7/1945 | Crandall | 114/45 |
| 3,054,267 | | 9/1962 | Alcorn et al. . | |
| 3,097,495 | * | 7/1963 | Laborde et al. | 405/205 |
| 3,621,662 | * | 11/1971 | Starr et al. | 405/205 X |
| 3,633,369 | | 1/1972 | Lawrence . | |
| 3,736,756 | * | 6/1973 | Lloyd | 405/204 |
| 3,823,564 | | 7/1974 | Crout et al. . | |
| 3,859,804 | | 1/1975 | Koehler et al. . | |
| 3,878,688 | * | 4/1975 | Purvis | 405/7 |
| 3,987,637 | | 10/1976 | Koehler . | |
| 4,086,777 | * | 5/1978 | Lai | 405/195.1 |
| 4,683,832 | * | 8/1987 | Dysarz | 114/258 |
| 4,690,586 | * | 9/1987 | Oksuzler | 405/209 |
| 4,825,791 | * | 5/1989 | Foster, Jr. et al. | 405/203 X |
| 4,874,269 | * | 10/1989 | Dysarz | 405/209 |
| 4,927,296 | | 5/1990 | Kaldenbach . | |
| 5,097,786 | * | 3/1992 | Sheffield | 114/258 |
| 5,111,764 | | 5/1992 | D'Ettorre . | |

FOREIGN PATENT DOCUMENTS

| | | |
|---|---|---|
| 3219968 | 12/1983 | (DE) . |
| 910358 | 5/1991 | (NO) . |
| 9826979 | 6/1998 | (WO) . |
| 9906270 | 2/1999 | (WO) . |

* cited by examiner

*Primary Examiner*—David Bagnell
*Assistant Examiner*—Jong-Suk Lee
(74) *Attorney, Agent, or Firm*—Birch, Stewart, Kolasch & Birch, LLP

(57) ABSTRACT

A transporter for use in a method for removing a jacket for an offshore platform includes an oblong structure rotatable by ballasting, with a sliding saddle which is movable in the longitudinal direction of the oblong structure and adapted for securing the jacket, thus enabling the jacket to be moved in relation to the transporter by the sliding saddle after being attached to the sliding saddle and released from the seabed.

22 Claims, 6 Drawing Sheets

METHOD AND TRANSPORTER FOR INSTALLATION OR REMOVAL OF A JACKET FOR AN OFFSHORE PLATFORM

This application is the national phase under 35 U.S.C. §371 of PCT International Application No. PCT/NO97/00343 which has an International filing date of Dec. 17, 1997, which designated the United States of America.

FIELD OF THE INVENTION

The invention concerns a method and a transporter for installation or removal of a jacket for an offshore platform.

BACKGROUND OF THE INVENTION

The installation of offshore platforms is relevant in connection with the development of oil and gas fields at sea.

The removal of offshore platforms, consisting of deck and jacket, is a field which will become more important in the coming years, with the decommissioning of a number of offshore platforms.

Offshore platforms can be removed by being split up into smaller parts, for example by means of cutting torches or blasting, whereupon each of these smaller parts can be lifted aboard a barge or a ship and transported away. Regardless of how the splitting up is carried out, however, the costs associated with the breaking up and subsequent transport in smaller parts are substantial.

Thus, it is a wish to split up a platform which has to be removed into the fewest possible parts, in which case a natural division is to divide it into deck and jacket, each of which is removed separately. In the case of small platforms with low weight this is relatively problem-free, while in the case of large and heavy platforms it entails lifting with extremely large and expensive crane vessels, if it is even possible at all within the scope of what can be implemented in practice.

Norwegian patent application no. 91 0358 describes a method for removal of a platform jacket, wherein a device in the form of a ballastable hull with a deck which is arranged to receive the jacket is rotated into an approximately vertical position in which the deck is located parallel to the platform jacket. The platform jacket is secured to the deck and released from the seabed, whereupon the hull is rotated by means of ballasting to a position where the deck and the jacket arc located horizontally in the water. The device has a U-shaped cross section, and in addition to the deck comprises two long sides arranged at the side of the deck. With the method and the device according to Norwegian patent application no. 91 0358 it is thereby possible to remove a platform jacket from the seabed. The described method and device do not, however, solve the whole problem of removing a platform jacket, since during the transfer of the jacket from the device to a quay or a barge the same problem again arises as to how to move such a heavy structure without dividing it up into smaller parts.

SUMMARY OF THE INVENTION

The object of the invention is to provide a method and a transporter for removal of a jacket for an offshore platform, with subsequent transfer of the jacket to a receiver.

The object is further to provide a transporter which will also be able to be used for removal of a platform deck from a jacket, and transport of other heavy objects at sea.

A further object is to be able to use the same transporter for installation of a jacket for an offshore platform, and installation of a deck on the jacket.

The second object is achieved with a transporter of the type mentioned in the introduction, which, is also characterized by the features which are stated in the claims in the applicant's copending submitted Norwegian patent applications, Nos. 973562 and 973563.

The third object is achieved by employing a transporter according to the invention with a method which corresponds to the method according to the invention, but where the actions are performed conversely and the steps are performed in the reverse order.

The method according to the invention comprises the following steps:

a) an oblong ballastable transporter is rotated by means of ballasting from a position where a longitudinal underside of the transporter is lying horizontally in the water to a position where the transporter's underside is located beside an outer side of the jacket, b) the jacket is attached to a sliding saddle which is provided in the transporter and is movable in the transporter's longitudinal direction, c) the jacket is released from the seabed, d) the transporter with the jacket is rotated by means of ballasting to a position where the transporter's underside and the jacket are located substantially horizontally in the water, e) the transporter is moved to a receiver for the jacket, and f) the sliding saddle with the jacket are moved from the transporter to the receiver.

The transporter according to the invention includes an oblong, ballastable structure, rotatable across the longitudinal direction by means of ballasting, with a sliding saddle which is movable in the longitudinal direction and adapted for securing of the jacket, thus enabling the jacket to be moved in relation to the transporter by means of the sliding saddle, after being secured in the sliding saddle and released from the seabed.

The transporter according to the invention makes it possible to remove a platform jacket from the seabed, transport the jacket to a quay or possibly a barge for further transport, and transfer the jacket to the quay or the barge without the use of cranes.

The actual movement of the transporter will be conducted by tugs. The positioning of the transporter may be carried out by winches which can vary the length of wires between the transporter and the platform jacket or another fixed point.

Thus by means of the invention a rational and economically advantageous removal of a platform jacket is provided.

Further features and advantages will be seen in the detailed description.

The transporter according to the invention may also be employed in the installation of a jacket for an offshore platform. In the installation of a jacket a method is employed which corresponds to the method according to the invention, but where the steps are performed in the reverse order and the actions which are performed within each step are performed conversely. This is a clear variant of the method according to the invention, and will not be explained in detail. It should be understood, however, that the inventive concept also covers this alternative.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in more detail in association with a description of specific embodiments, and with reference to the drawings which are given by way of illustration only, and thus are not limitative of the present invention, in which.

DESCRIPTION OF THE PREFERRED EMBODIMENT

Figure 1:
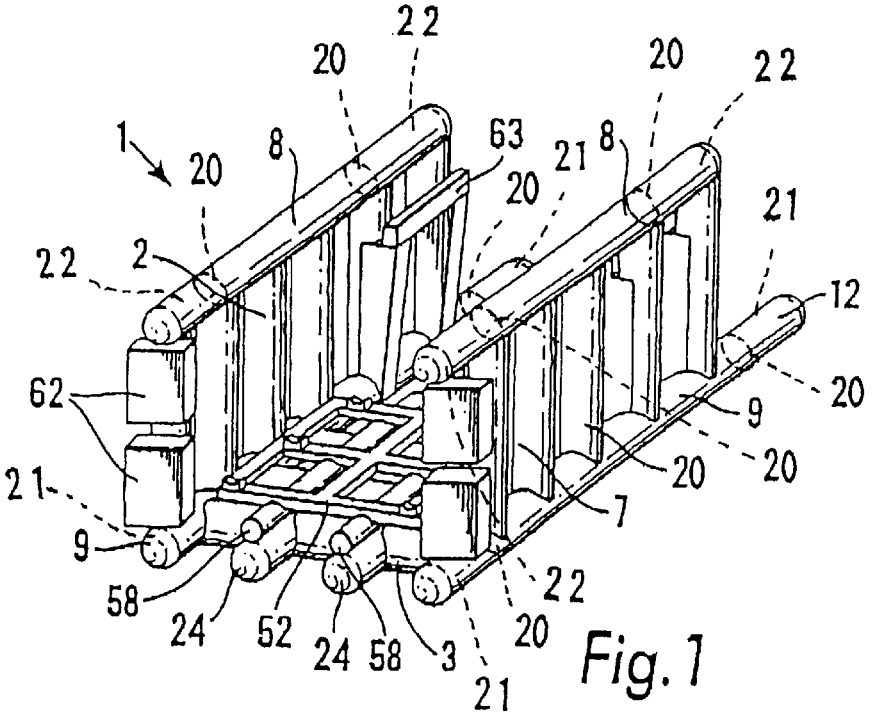
FIG. 1 is a perspective view of a transporter according to the invention.

FIG. 1 illustrates a transporter 1 according to the invention, comprising a longitudinal underside 3 and a long side 2 arranged on each side of the underside, the three sides together thereby forming an oblong structure with a U-shaped cross section. A sliding saddle 52 which is movable in the longitudinal direction of the transporter for securing a platform jacket is provided in the underside 3.

Lower longitudinal pontoons 9 are arranged in the corner areas between the underside 3 and the long sides 2, and upper longitudinal pontoons 8 are arranged in the long sides' upper sections. Ballasting chambers 21, 22 formed by the walls of the pontoons and partition walls 20 are provided in each of the ends of the pontoons 8, 9, which ballasting chambers 21, 22 preferably extend in towards the pontoons' central areas. Cross elements 7, which are also in the form of pontoons, containing ballasting chambers, connect the longitudinal pontoons 8, 9.

Together with an open top side, opposite to the underside 3, and two open short sides, the oblong structure forms a body with a prismatic enveloping surface. The ballasting chambers are thereby located in the points of intersection between edge lines formed by the intersections between the surfaces of the long sides 2, the underside 3, the open top side and the open short sides, with the result that a ballasting chamber is arranged in each of the prismatic enveloping surface's 8 corners. Thus, when ballasting/deballasting the transporter it is possible to rotate it to the desired position in the water.

Figure 2A:
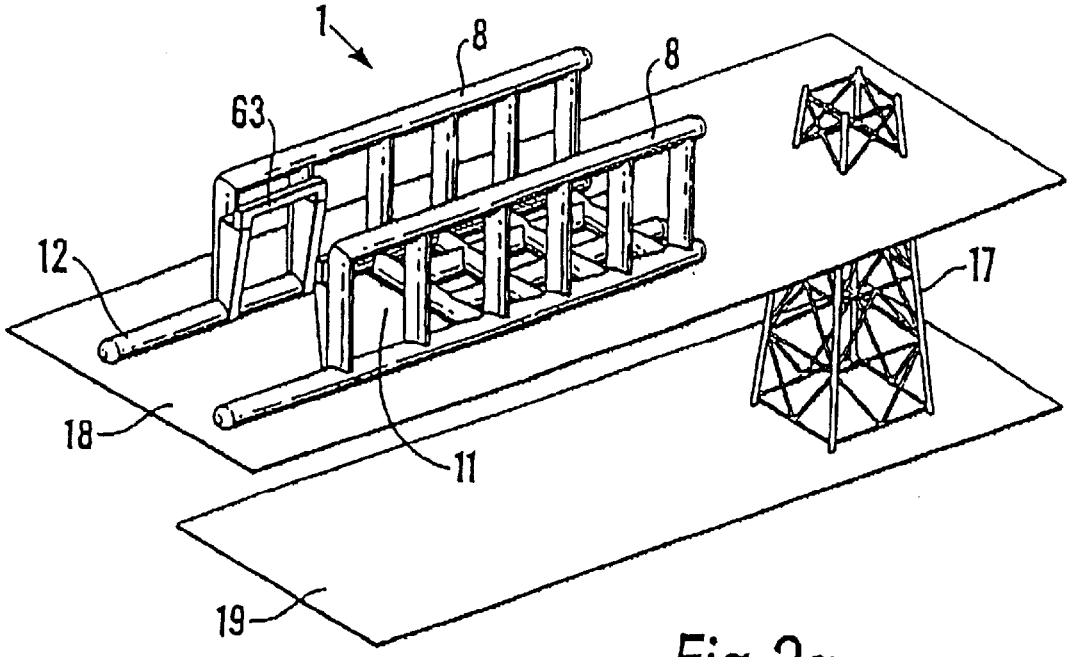
FIGS. 2*a–g* illustrate a sequence in which a transporter according to the invention removes a platform jacket from the seabed, and transfers the jacket to a receiver.

At one end of the transporter the long sides 2 project past the underside 3, thus forming a recess 11 in the underside, see FIG. 2*a*. On each side of the recess 11 there are provided two lifting beams 63. The recess 11 and the lifting beams 63 have their function in the use of the transporter to remove platform decks, which function is not an object of this patent application. In the extension of the recess 11 the lower longitudinal pontoons 9 project past the long sides 2 in portions or sections 12, which also have their main function in removing platform decks. The outwardly projecting sections 12, however, also have a function in the present invention, since they contain ballasting chambers which are used in rotation of the transporter.

The transporter also comprises two longitudinal pontoons 24 in the underside 3. The longitudinal pontoons 24 are provided with grooves or rails 58 to carry the sliding saddle 52 and guide its movement.

In addition, not shown, the transporter comprises piping, valves, pumps with motors and control equipment for performing the ballasting/deballasting. The ballasting/deballasting are remotely controlled by means of not shown communication equipment Alternatively, the ballasting/deballasting may be conducted with an umbilical which contains both pressurized water for ballasting and pressurized air for deballasting, together with pressurized fluid for operation and control of the valves.

The transporter illustrated in FIG. 1 further comprises permanently mounted cutting equipment, illustrated schematically in the form of four boxes 62, for cutting the jacket after it is attached to the sliding saddle. As illustrated in FIG. 1 the cutting equipment 62 on the left side of the transporter is arranged closer to the sliding saddle than the cutting equipment on the right side, which illustrates that the cutting equipment is laterally adjustable to enable it to be adapted to different designs or positions of the jacket.

During transport of the transporter, which is carried out by tugs, it is advantageous to deballast the transporter, so that it provides as little resistance to motion as possible. In most cases this will mean that it is advantageous to place the transporter in a position where it is located with the underside 3 down, as high as possible in the water.

In a preferred embodiment, not shown, the underside 3 between the lower longitudinal pontoons 9, compared to the lower longitudinal pontoons 9, is located closer to transporter's central area. The result of this is that the underside is at least partly located above the water when the transporter is lying deballasted in the water with the lower longitudinal pontoons down, the underside thus offering little or no resistance to the movement in the water during transport.

FIGS. 2*a–g* show a sequence illustrating the method according to the invention, where a transporter according to the invention removes a platform jacket from the seabed, and transfers the jacket to a receiver.

FIG. 2*a* shows the ballastable transporter 1 lying horizontally in the water 18, with the longitudinal underside 3 facing down. The transporter is located beside a platform jacket 17 which is located on the seabed 19.

Figure 2B:
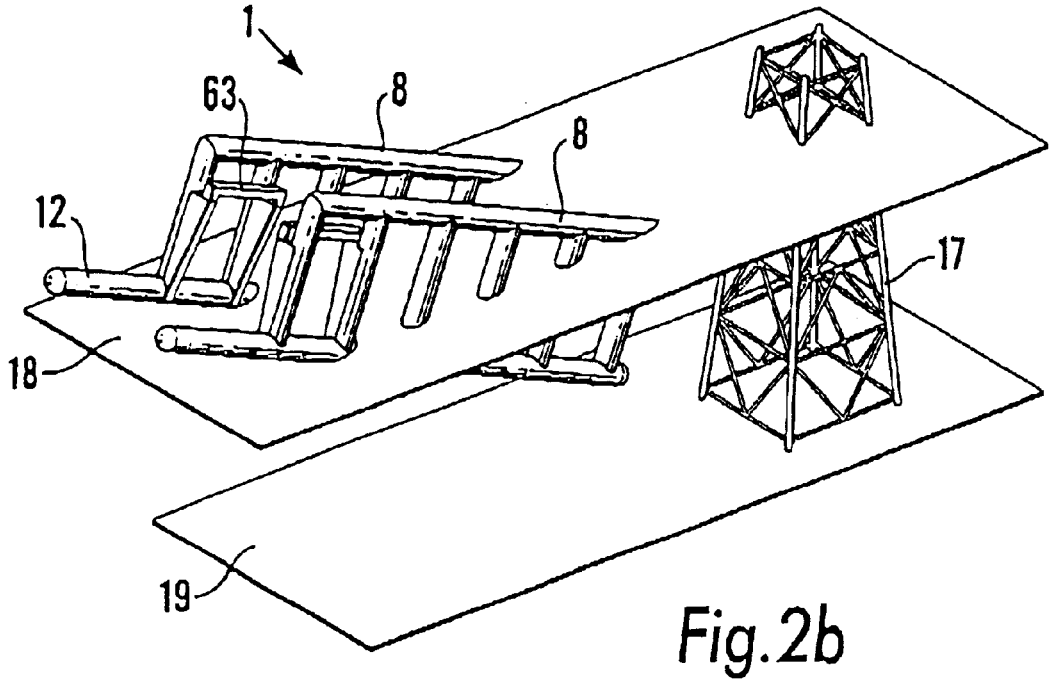
Figure 2C:
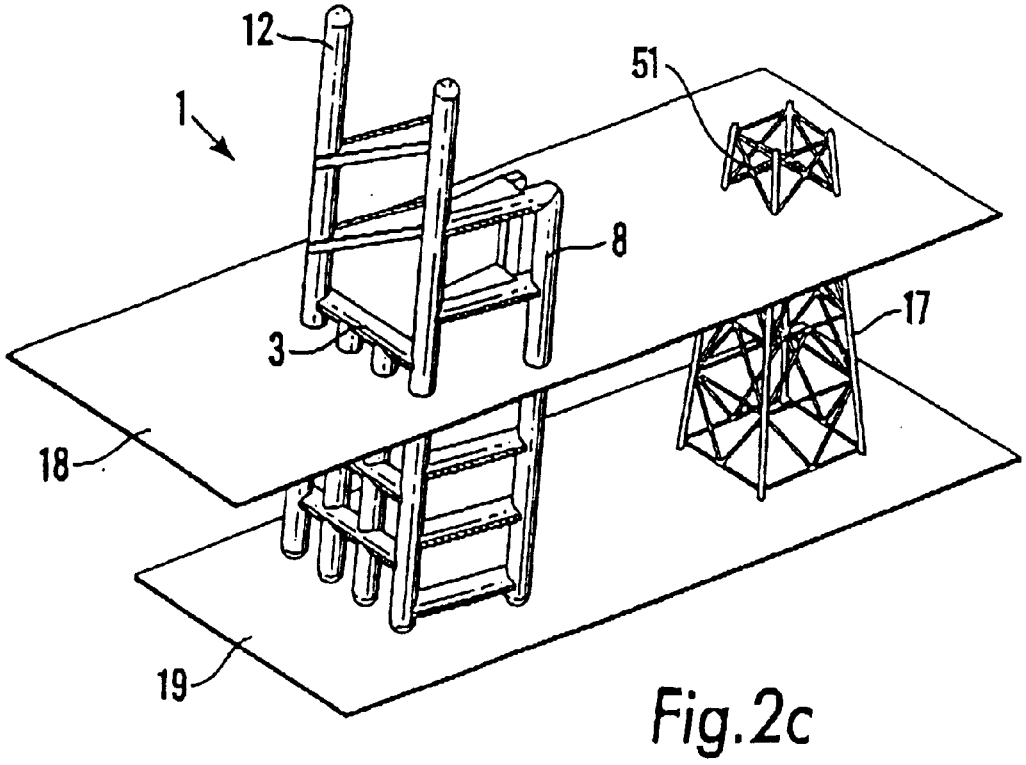

FIGS. 2*b* and 2*c* illustrate the transporter during and after the completion of rotation to an essentially vertical position in the water respectively, beside the jacket 17. Here the underside 3 of the transporter faces an outer side 51 of the jacket.

Figure 2D:
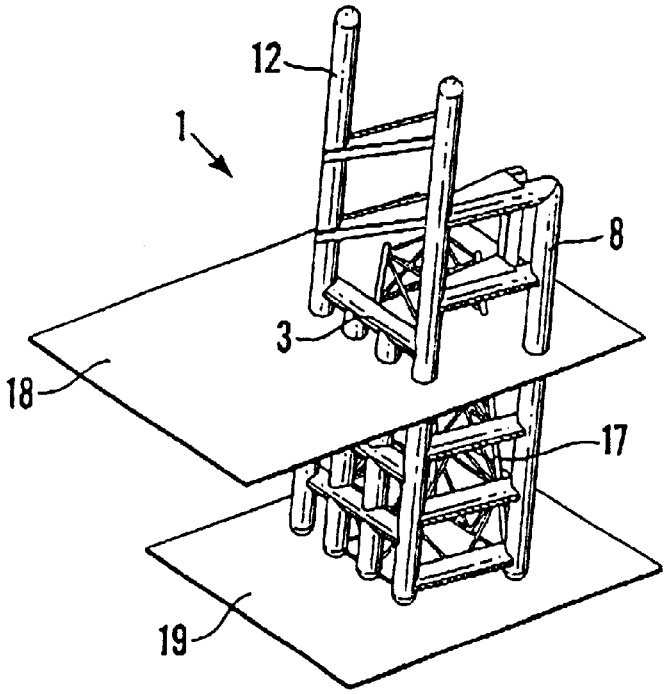

FIG. 2*d* illustrates the transporter moved in towards the jacket, where the jacket abuts against the transporter's underside, between the transporter's long sides, for attachment of the jacket to the sliding saddle.

Figure 2E:
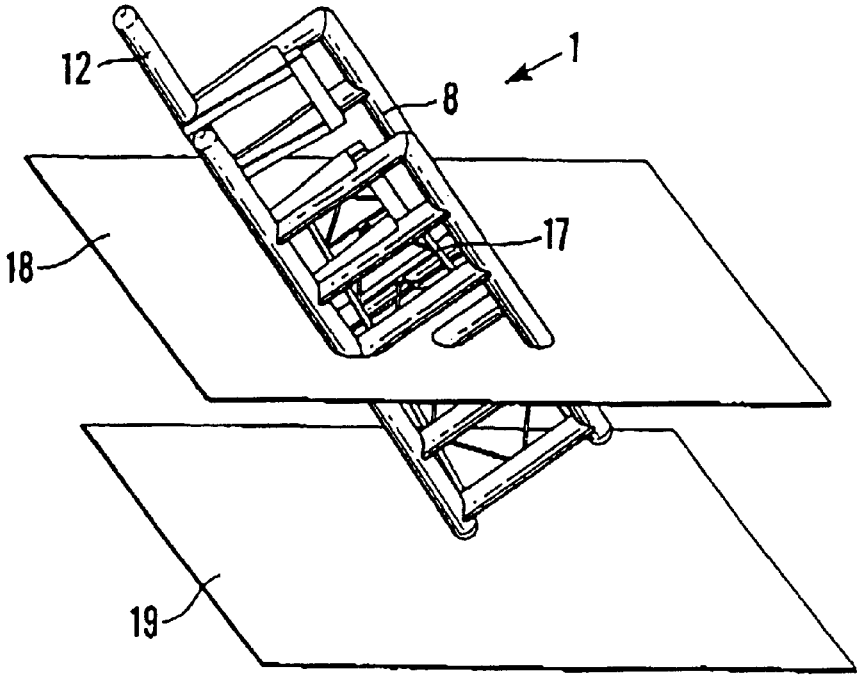

FIG. 2*e* illustrates the transporter with the sliding saddle during rotation to a horizontal position, after the jacket has been attached to the transporter and released from the seabed, preferably by means of cutting equipment 62.

Figure 2F:
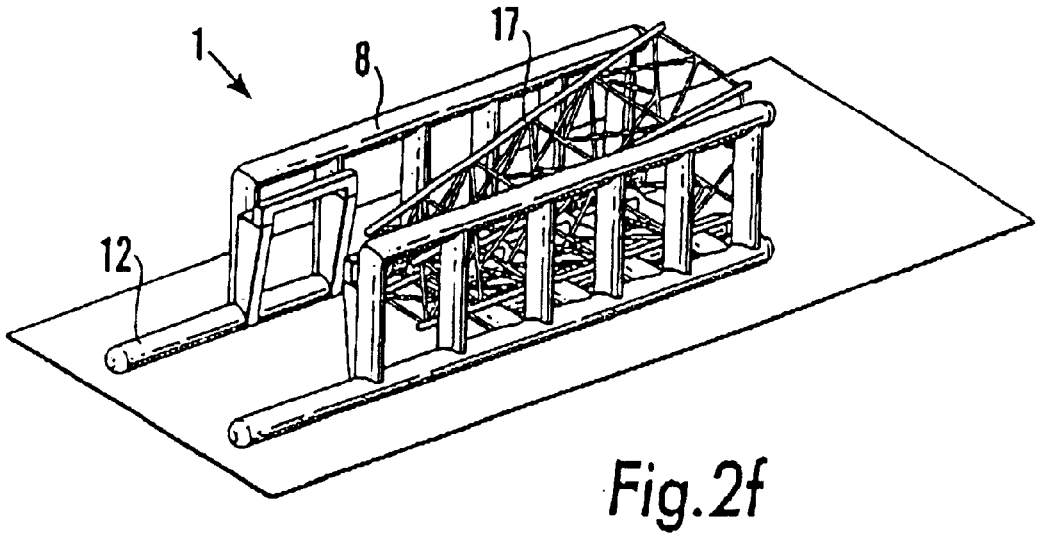

FIG. 2*f* illustrates the transporter with the jacket after rotation to a horizontal transport position.

Figure 2G:
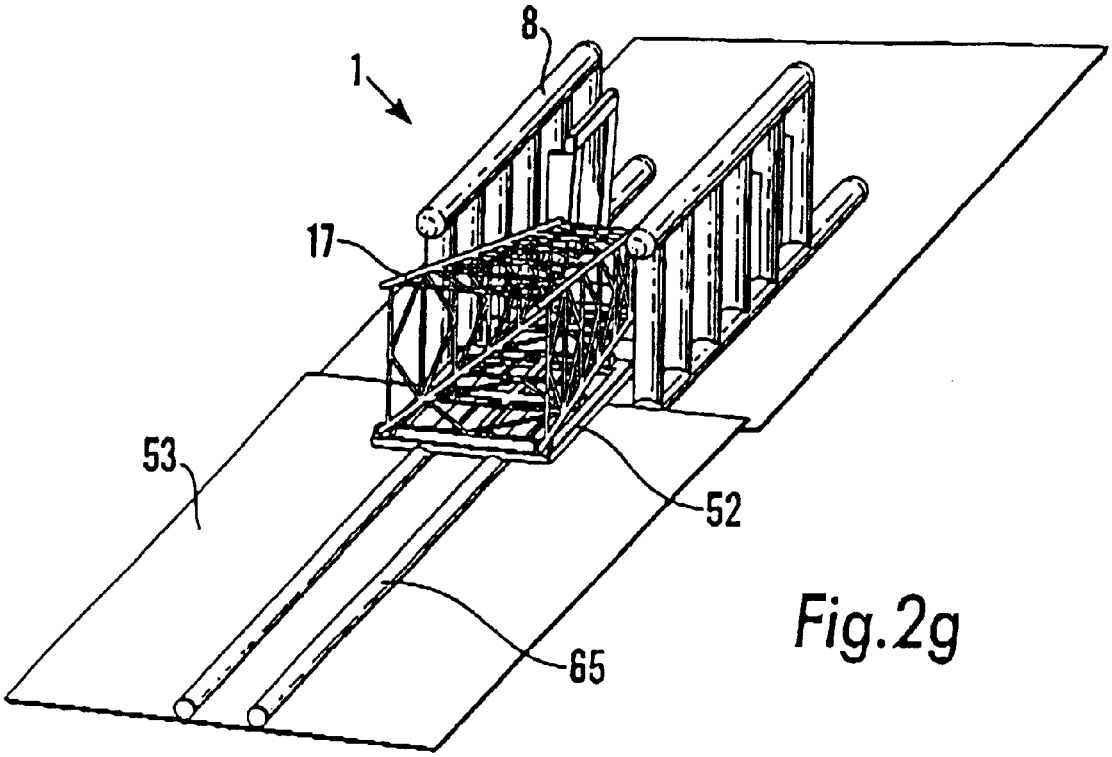

FIG. 2*g* illustrates the transporter after it has been moved to a receiver 53 for the jacket, where the sliding saddle 52 with the jacket 17 are in the process of being moved from the transporter to the receiver. Here the sliding saddle is transferred from the transporter's groove or rails 58 to corresponding grooves or rails 65 in the receiver.

Figure 3:
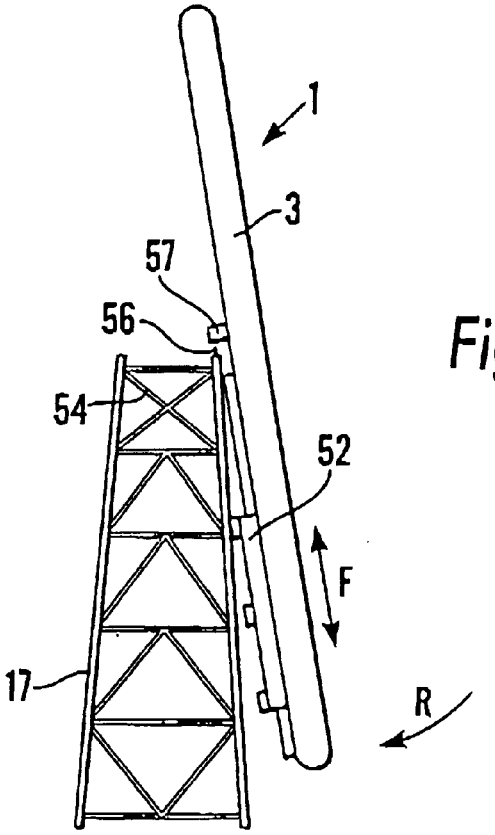
FIG. 3 illustrates the transporter during securing of the jacket.

FIG. 3 illustrates the transporter 1 during attachment of the jacket 17 according to a preferred embodiment of the invention. In order to better illustrate this preferred embodiment the sides of the transporter have been omitted. Here the transporter 1 has been rotated from a horizontal position in the water to a position in which contact sections 57 on the transporter, located above the sliding saddle 52, abut against and are attached to corresponding contact sections 56 on an upper portion 54 of the jacket, while the sliding saddle is located at a distance from the jacket. The transporter is then rotated in towards the jacket about the jacket's upper portion 54, in the direction shown by the arrow R, for securing of the jacket in the sliding saddle 52. It should be understood that the rotation of the transporter will be an adaption of the transporter's position rather than a rotation about a fixed axis. After being secured in the sliding saddle and released from the seabed, the jacket can thereby be moved in relation to the transporter in its longitudinal direction, shown by the arrow F.

Figure 4:
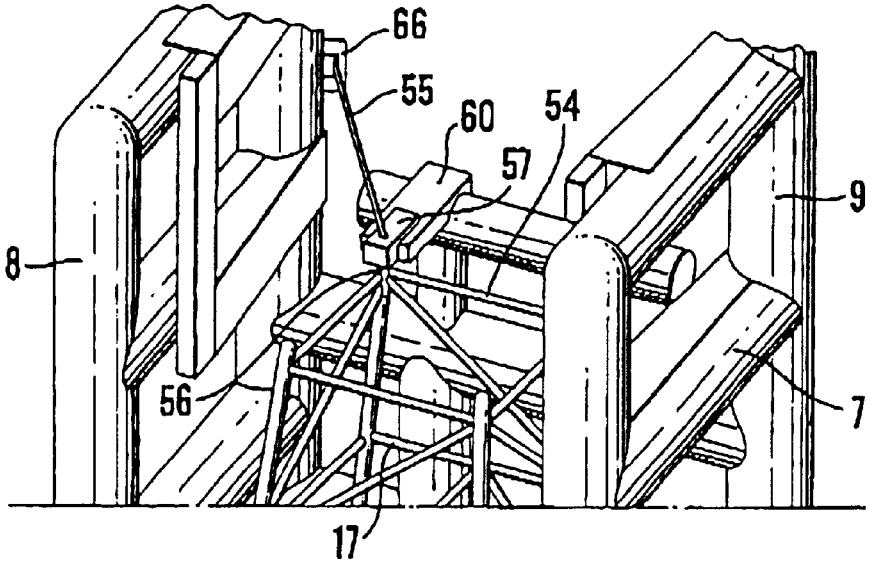
FIG. 4 illustrates an upper section of the jacket secured to the transporter.

FIG. 4 shows a design of an attachment of the jacket's upper portion 54 in the transporter. Here the jacket's contact sections 56 are composed of guide pins or dowels, while the transporter's corresponding contact sections 57 are composed of housings. Tension elements 55 in the form of tie rods extend from the guide pins 56, through the housings 57, and on to the tension devices 66 on the transporter. When the jacket is secured the tension elements 55 by means of the tension devices 66 pull the guide pins 56 into the housings 57, thus causing the latter to abut against one another. In order to obtain a secure connection the guide pins and the housings are preferably conical. The tension in the tension elements 55 is maintained after a secure connection has been attained between the contact sections 56 and 57, thus transferring the weight of the jacket to the tension elements.

Figure 5:
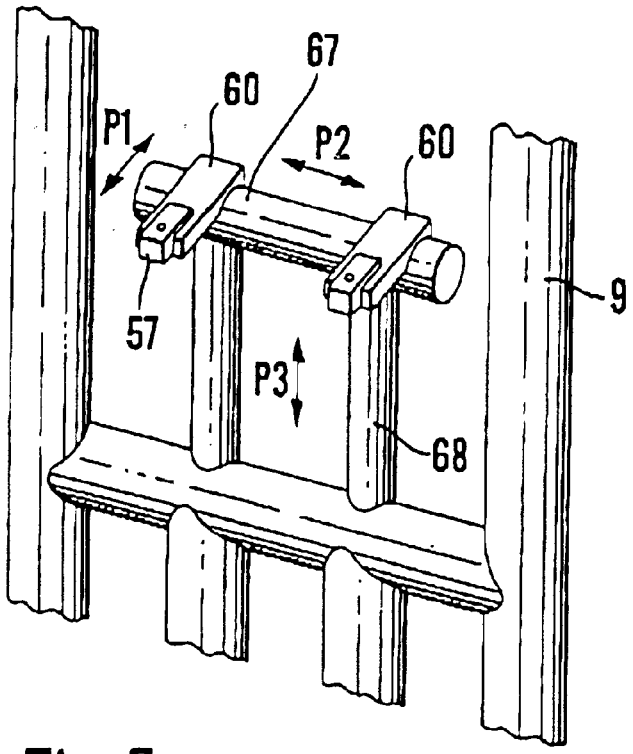
FIG. 5 illustrates brackets on the transporter, for securing the jacket.

FIG. 5 illustrates bow the housings 57 illustrated in FIG. 4 in a preferred embodiment are attached in outwardly projecting brackets 60. The brackets are movable in a plane perpendicular to the transporter's underside, towards and away from the jacket, shown by the arrow P1. The brackets are secured in telescopically movable tubes 67 which are movable in the underside's plane, perpendicular to the transporter's longitudinal direction, shown by the arrow P2. The tubes 61 are secured in turn in telescopically movable tubes 68 which are movable in the underside's plane, in the transporter's longitudinal direction, shown by the arrow P3.

Figure 6:
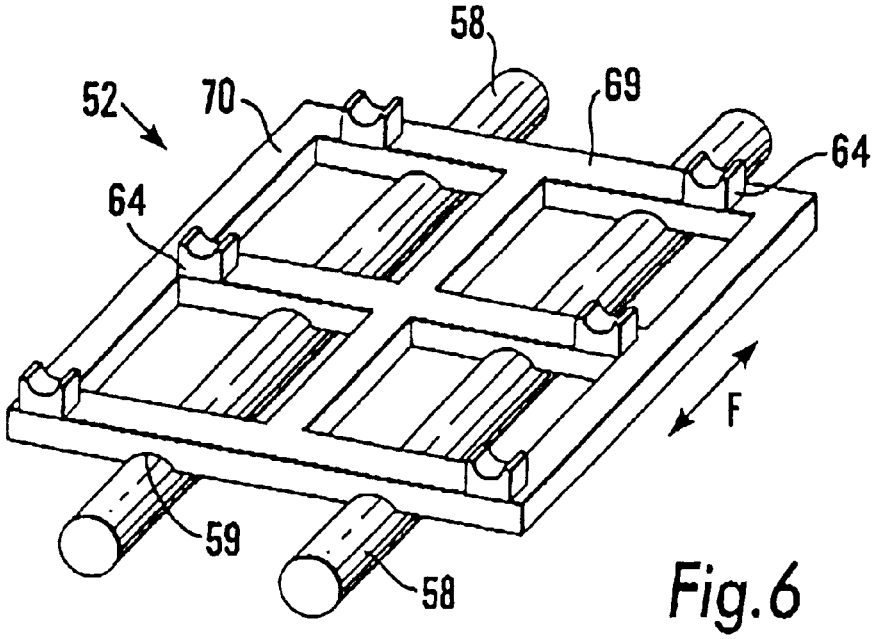
FIG. 6 illustrates a sliding saddle for the transporter according to the invention.

FIG. 6 illustrates the sliding saddle 52 in closer detail. The sliding saddle includes a frame of transverse elements 69 and longitudinal elements 70. Sliding or rolling portions 59 are attached to the frame for co-operation with the transporter's grooves or rails 58, shown here as tubes, which are secured to the transporter's underside and extend in its longitudinal direction. The sliding saddle is further provided with supports 64 for the jacket, which supports may be laterally movable for adaptation to the jacket. The supports 64, and possibly also the transvere elements 69 and the longitudinal elements 70, have lugs, eyes or brackets (not shown) for securing the jacket by bolting, wires or other appropriate means. After being secured in the sliding saddle and released from the seabed, the jacket can thereby be moved in relation to the transporter in its longitudinal direction, shown by the arrow F.

Moving the jacket in the transporter's longitudinal direction can be useful for adapting various attachment means when securing the jacket. The moving can also be useful for optimizing the position of the jacket's center of gravity in relation to the transporter, thus permitting the transporter to be located horizontally in the water during transport.

The greatest advantage of the sliding saddle is however the transfer of the jacket to a receiver. Such a receiver may be a quay at a building site, or it may be a barge for transport of the jacket to a shipbreaker's yard. The moving of the sliding saddle with the jacket may, for example, be carried out by pulling or pushing it along the grooves or the rails 58. It is, of course, also possible to perform the moving in other ways, such as with a built-in motor in the sliding saddle, or by tilting the transporter and its rails or grooves, thus causing the sliding saddle with the jacket to slide off by themselves due to the force of gravity.

In the illustrated embodiment the sliding saddle is transferred to grooves or rails 65 on the receiver, arranged in an extension of the transporter's grooves or rails 58. Depending on the design of the sliding saddle it may also be transferred to a receiver without being moved over on grooves or rails. This may be done, for example, by providing the sliding or rolling portions 59 with rollers, or by employing loose rollers between the receiver and the sliding saddle's longitudinal elements 70.

Further advantageous designs and applications of the transporter, associated with the removal of a platform deck from a jacket and transport of other heavy objects at sea are shown and described in the applicant's Norwegian patent applications Nos. 973562 and 973563.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for removal of a jacket for an offshore platform, the method comprising the steps of:

rotating an oblong ballastable transporter by ballasting from a first position where a longitudinal underside of the transporter is lying substantially horizontally in water to a second position where the underside is located beside an outer side of the jacket;

attaching a sliding saddle provided on the transporter directly to the jacket, the sliding saddle being movable in a longitudinal direction of the transporter;

releasing the jacket from a seabed;

rotating the transporter with the jacket by ballasting to the first position where the underside of the transporter and the jacket are located in a substantially horizontal position in the water;

moving the transporter to a receiver for the jacket; and moving the sliding saddle with the jacket from the transporter to the receiver.

2. The method according to claim 1, wherein the sliding saddle is movable with the transporter from the first substantially horizontal position to the second position wherein the transporter and sliding saddle are substantially upright.

3. The method according to claim 1, further comprising the steps of:

abutting the transporter against an upper portion of the jacket during the step of rotating to a location beside an outer side of the jacket; and attaching the transporter to the upper portion of the jacket during the step of attaching whereafter the transporter is rotated towards the jacket about the upper portion of the jacket for attachment of the jacket in the sliding saddle, the sliding saddle being provided in the transporter below a portion of transporter which abuts with the upper portion of the jacket.

4. The method according to claim 3, further comprising the step of securing the jacket in the underside of the transporter by tension elements which pull contact sections on the jacket towards corresponding contact sections on the transporter, the step of securing occurring during the step of attaching the jacket.

5. The method according to claim 1, further comprising the step of moving the sliding saddle and jacket along the transporter in order to optimize a position of a center of gravity of the jacket in relation to the transporter.

6. The method according to claim 1, further comprising the step of moving the sliding saddle and jacket from the transporter to the receiver.

7. The method according to claim 6, wherein the step of moving comprises pushing or pulling the sliding saddle and jacket and wherein the receiver is a barge or quay.

8.The method according to claim 1, further comprising the step of removing a platform deck from the jacket by using the transporter.

9. The method according to claim 8, wherein the step of removing includes the step of using at least one lifting beam on the transporter during removal of the platform deck.

10. A transporter for installation or removal of a jacket for an offshore platform comprising:

an oblong ballastable structure rotatable across a longitudinal direction by ballasting, the oblong structure has a U-shaped cross section and includes two long sides and an intermediate underside with an open side being provided between the two long sides and being opposed to the underside;

a sliding saddle on the underside of the oblong structure, the sliding saddle being attachable to the jacket whereby the jacket is movable along the oblong structure by the saddle after the jacket is released from a seabed; and ballasting chambers in corners of the oblong structure, the ballasting chambers enable the transporter to be rotatable by ballasting to a desired position in water.

11. The transporter according to claim 10, wherein the oblong structure has eight corners and wherein at least one ballasting chamber is provided in each of the corners.

12. The transporter according to claim 11, wherein the sliding saddle is attached by grooves or rails to the underside of the oblong structure.

13. The transporter according to claim 12, wherein the transporter is movable between a first position and a second position, the transporter being substantially horizontal in the first position and being located beside an outer side of the jacket in the second position, a majority of the transporter being submergible when in the second position.

14. The transporter according to claim 11, wherein the jacket is received through the open side of the oblong structure and held between the two long sides during transport.

15. The transporter according to claim 10, wherein the transporter is movable between a first position and a second position, the transporter being substantially horizontal in the first position and being located beside an outer side of the jacket in the second position, a majority of the transporter being submergible when in the second position.

16. The transporter according to claim 10, wherein the sliding saddle is attached by grooves or rails to the underside of the oblong structure.

17. The transporter according to claim 16, further comprising sliding or rolling portions provided on the sliding saddle, the sliding or rolling portions being movable along the grooves or rails.

18. The transporter according to claim 10, wherein the transporter is rotatable between a first position and a second position, the transporter being substantially horizontal in the first position and wherein the transporter further comprises contact sections for abutment against corresponding contact sections on an upper portion of the jacket when the transporter is rotated to a second position located beside the jacket, the jacket being first attached to the contact sections on the transporter and thereafter the transporter is rotated towards the jacket in order to attach the jacket to the sliding saddle.

19. The transporter according to claim 18, wherein the contact sections on the transporter are provided on laterally adjustable brackets.

20. The transporter according to claim 10, further comprising cutting equipment permanently mounted on the transporter, the cutting equipment being used to cut the jacket after the jacket is secured to the sliding saddle.

21. The transporter according to claim 10, wherein lower longitudinal pontoons are provided between the underside and the long sides of the oblong structure and wherein the underside is located closer to a central area of the transporter than the longitudinal pontoons whereby when the transporter is lying in water with the lower longitudinal pontoons down, the underside is located at least partially above the water.

22. The transporter according to claim 10, further comprising means for removal of a platform deck from the jacket.

* * * * *